US009822497B2

(12) United States Patent
Doan

(10) Patent No.: US 9,822,497 B2
(45) Date of Patent: Nov. 21, 2017

(54) TREATING PARTICULATE AND CONNECTING SLAB PORTIONS

(71) Applicant: RIGID GROUND PTY LTD, Vermont South, Victoria (AU)

(72) Inventor: Tu Ngoc Doan, Mulgrave (AU)

(73) Assignee: RIGID GROUND PTY LTD, Victoria (AU)

( * ) Notice: Subject to any disclaimer, the term of this patent is extended or adjusted under 35 U.S.C. 154(b) by 137 days.

(21) Appl. No.: 15/101,821

(22) PCT Filed: Dec. 3, 2013

(86) PCT No.: PCT/AU2013/001403
§ 371 (c)(1),
(2) Date: Jun. 3, 2016

(87) PCT Pub. No.: WO2014/089600
PCT Pub. Date: Jun. 19, 2014

(65) Prior Publication Data

US 2016/0305076 A1 Oct. 20, 2016

(30) Foreign Application Priority Data

Dec. 13, 2012 (AU) ..... 2012905449

(51) Int. Cl.
*E01C 23/10* (2006.01)
*B28D 1/14* (2006.01)
(Continued)

(52) U.S. Cl.
CPC ..... *E01C 23/10* (2013.01); *B28D 1/14* (2013.01); *E01C 7/147* (2013.01); *E01C 11/005* (2013.01);
(Continued)

(58) Field of Classification Search
CPC ..... E01C 23/10; E01C 11/005; E01C 7/147; E01C 11/14; E04G 23/0229;
(Continued)

(56) References Cited

U.S. PATENT DOCUMENTS 1,915,032 A * 6/1933 Poulter ..... E01C 23/10 104/11
4,084,381 A 4/1978 Cain et al.
(Continued)

FOREIGN PATENT DOCUMENTS

CN 1369596 A 9/2002
CN 102031747 A 4/2011
(Continued)

OTHER PUBLICATIONS

EPO Search Report and Written Opinion for corresponding application 13862570.2 dated Jun. 26, 2017 (7 pages).*
(Continued)

*Primary Examiner* — Rodney Mintz
(74) *Attorney, Agent, or Firm* — David D. Brush; Westman, Champlin & Koehler, P.A.

(57) ABSTRACT

A method of treating particulate, in substance including selecting a load based on a planned in use loading of the particulate; applying the load to the particulate; injecting material below the load; and removing the load.

19 Claims, 4 Drawing Sheets

(51) Int. Cl.

| | |
|---|---|
| ***E02D 3/12*** | (2006.01) |
| ***E04G 23/02*** | (2006.01) |
| ***E01C 7/14*** | (2006.01) |
| ***E01C 11/00*** | (2006.01) |
| ***E02D 37/00*** | (2006.01) |
| *E01C 11/14* | (2006.01) |

(52) U.S. Cl.
CPC ..... *E02D 3/12* (2013.01); *E02D 37/00* (2013.01); *E04G 23/0203* (2013.01); *E04G 23/024* (2013.01); *E04G 23/0211* (2013.01); *E04G 23/0229* (2013.01); *E01C 11/14* (2013.01); *E02D 2300/0006* (2013.01); *E02D 2300/0023* (2013.01)

(58) Field of Classification Search
CPC ..... E04G 23/0211; E04G 23/024; E04G 23/0203; E02D 37/00; E02D 3/12; E02D 2300/0023; E02D 2300/0006; B28D 1/14
USPC ..... 404/78
See application file for complete search history.

(56) References Cited

U.S. PATENT DOCUMENTS

| | | | | |
|---|---|---|---|---|
| 4,092,832 | A * | 6/1978 | Mattson | E02D 35/00 404/78 |
| 4,453,360 | A | 6/1984 | Barenberg | |
| 4,563,110 | A * | 1/1986 | Langenbach, Jr. | E04G 23/04 405/230 |
| 4,567,708 | A | 2/1986 | Haekkinen | |
| 4,591,466 | A | 5/1986 | Murray et al. | |
| 6,052,964 | A | 4/2000 | Ferm et al. | |
| 6,485,232 | B1 | 11/2002 | Vinegar et al. | |
| 6,521,673 | B1 * | 2/2003 | Brown | C08G 18/4804 404/78 |
| 6,532,714 | B1 * | 3/2003 | Ferm | E01C 7/147 404/64 |
| 6,976,804 | B1 * | 12/2005 | Asplin | E01C 23/10 404/78 |
| 8,092,116 | B1 * | 1/2012 | Asplin | E01C 23/10 404/78 |
| 8,186,907 | B1 * | 5/2012 | Asplin | E01C 23/10 404/78 |
| 2002/0098042 | A1 | 7/2002 | Canteri | |
| 2003/0092787 | A1 * | 5/2003 | Brown | C08G 18/4804 521/130 |
| 2005/0158128 | A1 | 7/2005 | Canteri | |
| 2008/0236090 | A1 | 10/2008 | Liberman | |
| 2014/0137503 | A1 * | 5/2014 | Wheatley | E04G 23/0214 52/514.5 |
| 2016/0362901 | A1 * | 12/2016 | Tabatabai | E02D 37/00 |

FOREIGN PATENT DOCUMENTS

| | | | |
|---|---|---|---|
| EP | 0687781 | A1 | 12/1995 |
| EP | 1914350 | A1 | 4/2008 |
| GB | 415326 | A | 8/1934 |
| GB | 1515162 | A | 6/1978 |
| GB | 2037349 | A | 7/1980 |
| JP | 2002294685 | A | 10/2002 |
| JP | 2007309055 | A | 11/2007 |
| WO | 2011127528 | A1 | 10/2011 |

OTHER PUBLICATIONS

International Search Report dated May 1, 2014, for corresponding International Application No. PCT/AU2013/001403, filed Dec. 3, 2013.

International Preliminary Report on Patentability dated Apr. 23, 2015, for corresponding International Application No. PCT/AU2013/001403, filed Dec. 3, 2013.

Written Opinion dated May 1, 2014, for corresponding International Application No. PCT/AU2013/001403, filed Dec. 3, 2013.

Patent Examination Report dated Apr. 20, 2015 for corresponding Australian Patent Application No. 2013203965.

Patent Examination Report dated Apr. 20, 2015 for corresponding Australian Patent Application No. 2013203973.

Patent Examination Report dated Apr. 24, 2015 for corresponding Australian Patent Application No. 2013203950.

Patent Examination Report dated Apr. 24, 2015 for corresponding Australian Patent Application No. 2013203983.

Patent Examination Report dated Apr. 28, 2015 for corresponding Australian Patent Application No. 2013203933.

English translation of the Chinese Office Action dated May 22, 2017 for corresponding Chinese Application No. 201380081427.2.

* cited by examiner

TREATING PARTICULATE AND CONNECTING SLAB PORTIONS

CROSS-REFERENCE TO RELATED APPLICATIONS

This Application is a Section 371 National Stage Application of International Application No. PCT/AU2013/001403, filed Dec. 3, 2013, which is incorporated by reference in its entirety and published as WO 2014/089600 on Jun. 19, 2014, in English.

FIELD

The invention relates to treating particulate and to connecting slab portions.

The following description focuses on concrete slabs supported by particulate although various aspects of the disclosed methods and apparatus may suit other applications such as:

- treating particulate which does not, and is not intended to, carry a slab;
- treating particulate supporting semi-rigid structure such as asphalt; and
- connecting slab portions not supported by particulate.

"Particulate" as used herein takes in crushed rock, gravel, soil, earth, sand and clay, etc. and other materials (e.g. recycled materials) having similar characteristics.

BACKGROUND

Concrete slabs (e.g. formed of Portland cement) are employed in a variety of applications such as dwelling foundations. In applications such as roads, airport runways and warehouse floors the slabs may also form the exposed surface to which load is directly applied.

Typically slabs are formed by:

- grading the "native" soil;
- compacting the native soil and/or adding crushed rock, to form a top layer (referred to as a "sub-base") which may have a higher shear strength than the native soil;
- installing formwork about the sub-base to define the perimeter of the slab;
- filling the formwork with wet concrete; and
- allowing the concrete to set.

Alternatively, pre-cast slabs may be laid upon sub-base.

Larger areas, such as roads and runways, are typically formed of a pavement made up of multiple slabs. The multiple slabs may be poured simultaneously (and separated by suitable temporary or permanent formwork). Alternatively, each slab may be poured after its neighboring slab has set. Either way there is a defined boundary between the slabs.

In use, load applied to the slab (e.g. by car driving along the roadway including the slab or a person standing on a carpet floor supported by the slab) is in turn applied the underlying soil.

Concrete is weak and brittle in tension. A load applied to a concrete slab at a point of the slab inadequately supported by the soil may cause the slab to crack. The slab may be inadequately supported (by way of example) due to the load being excessive or the soil having subsided away from the load point.

Cracking can occur at the peripheral margins of a slab (and particularly at the adjacent margins of adjacent slabs) due to "pumping". When a slab is formed it typically takes on a slightly dished shaped due to differential rates of setting within the body of concrete. This is sometimes referred to "curling". The dished shape leads to a lower contact pressure (or in extreme cases a cavity) at the interface between slab and soil about the slab's peripheral margins. In turn this leads to relatively more ground water coming and going from the particulate matter under these peripheral margins. This water movement tends to "pump" soil away and so exacerbate the problem.

Cracking followed by ongoing loading usually leads to an accelerated rate of deterioration. Even if the crack is not a full thickness crack, the load dispersing characteristics of the slab are compromised. A load applied to either of the slab portions defined by the crack is concentrated on the soil underlying that slab portion rather than being more evenly distributed over the soil underlying the entire original slab. This concentrated loading usually leads to accelerated soil subsidence, etc.

In the past, cracked and sunken concrete has been repaired by injecting material into the underlying soil and adhesively attaching members to span the crack. The present inventors have recognised that these existing approaches are problematic. Often the soil continues to subside and the members come away from slab portions, leading to a further similar failure. Sometimes too much material is injected, leading to a raised portion in the slab.

Various aspects of the invention aim to provide improvements in and for treating particulate and connecting slab portions, or at least to provide alternatives for those concerned with treating particulate and connecting slab portions.

It is not admitted that any of the information in this patent specification is common general knowledge, or that the person skilled in the art could be reasonably expected to ascertain or understand it, regard it as relevant or combine it in any way at the priority date.

SUMMARY

One aspect of the invention provides a method, of treating particulate, in substance including selecting a load based on a planned in use loading of the particulate;

applying the load to the particulate;

injecting material below the load; and removing the load.

The method preferably includes, prior to the injecting, at least partly drying the particulate to reduce resistance to injection.

Also disclosed is a method, of treating particulate, in substance including at least partly drying the particulate to reduce resistance to injection;

applying a load to the particulate;

injecting material below the load; and removing the load.

The load is preferably selected to exert a pressure of at least 1,000 kg/m$^2$ (1.4 psi) averaged over the area of the particulate in need of treatment. By way of example, the load may be further particulate as in a "surcharge".

Also disclosed is a method, of treating particulate, in substance including at least partly drying the particulate to reduce resistance to injection; and injecting material.

The at least partly drying may be to reduce ground water pressure by about 40 kPa (5.8 psi) to about 80 kPa (11.6 psi). Preferably the at least partly drying is or includes vacuuming.

The injected material may be allowed to set and further material injected, preferably below the set material. This may involve creating a hole in the set material and the injecting further material may be injecting through the hole so created.

The methods of the foregoing aspects preferably include sequentially so injecting at a plurality of locations, and most preferably a first of the sequential injections is in substance at a centre of an or the area of the particulate in need of treatment. The depth of each injection in the sequence could be uniform or vary from hole to hole.

The methods of the foregoing aspects preferably include monitoring the effect(s) of injection and discontinuing injection in response to the monitoring.

Also disclosed is a method, of treating particulate, in substance including injecting material;

reducing a rate at which the material is injected to allow time for the effect(s) of injection to become apparent; and monitoring the effect(s) of injection; and discontinuing injection in response to the monitoring.

Reducing the rate of injection may be or include periodically pausing the injection (i.e. periodically reducing the rate to zero).

The monitoring preferably includes monitoring at two or more spaced locations.

Also disclosed is a method, of treating particulate, in substance including injecting material;

monitoring the effect(s) of injection at two or more spaced locations; and discontinuing injection in response to the monitoring.

Preferably the monitoring is or includes monitoring surface displacement.

The injected material may be an expanding material.

Preferably the particulate is supporting a structure, in which case preferably the method involves sequentially injecting material below the structure to a plurality of injection points spaced about and in proximity to a periphery of the structure's footprint on the particulate.

Also disclosed is a method of treating particulate to raise a structure supported by the particulate, including sequentially injecting material below the structure to a plurality of injection points spaced about and in proximity to a periphery of the structure's footprint on the particulate. Material may also be injected at other points (e.g. at the centre of the structure or its footprint).

The injecting may be in substance injecting material into particulate below a sub-base. The injecting may be injecting through at least one hole in the structure, and the method may include creating the hole(s). The structure may be in substance a slab.

Also disclosed is a method, of interconnecting slab portions, in substance including removing material from the slab portions to create an elongate feature extending from one of the slab portions into the other of the slab portions and including at least one side formation in each slab portion; and inserting into the elongate feature a connection arrangement to co-operate with the side formations to resist lengthwise shear separation.

Preferably inserting a connection arrangement includes inserting settable material such that the settable material conforms to the side formations, and allowing or causing the so conforming settable material to set to form keys. By way of example, the settable material may be epoxy or urethane.

Preferably inserting a connection arrangement includes inserting an elongate member, which elongate member may include a portion more flexible than its other portions to accommodate relative movement of the slab portions. The more flexible portion may be or include a transverse deviation.

The elongate member preferably includes side formations for resisting lengthwise shear separation. The side formations of the elongate member are preferably female. By way of example, the elongate member may be formed of sheet material.

Preferably the elongate feature is at least as deep as the elongate member is high to fully receive the elongate member. A preferred form of the elongate member is at least 3 times as long as it is high.

The removing material preferably is or includes cutting a slot and drilling holes along the slot.

Preferably the removing material is in substance to a depth in the range of ⅓ to ⅔ of a depth of a thinner of the slab portions.

Also disclosed is a method, of repairing one or more slabs supported by particulate, including treating the particulate in the vicinity of a feature defining two slab portions; and connecting the slab portions.

The feature defining two slab portions may be or include one or more cracks, or may be a boundary between two slabs.

Also disclosed is a joint tie, for tying adjacent slab portions, shaped for receipt within a slot cut into the slab portions and including a portion more flexible than its other portions to accommodate relative movement of the slab portions.

Also disclosed is a method for repairing damaged or sunken rigid pavement by lifting the sunken slab or a sunken portion of a slab with adequate pre-loading on sunken portion and restoring tensile strength across the slab to prevent future resettlement by:

loading the sunken portion of the slab with weight during injection to simulate actual in service loading condition to prevent further settlement, injecting a hardenable material through the concrete layer and sub-base in multiple passes, while the upward movement of the slab is continuously monitored at more than one location, affixing of formed joint ties to replace failed load transfer dowels or to restore tensile strength of the rigid pavement across cracks against vertical load.

The added weight might be vehicular axle weight or weight blocks on wheels. Preferably the injection hole is made by drilling 8 mm (0.315 inches) to 30 mm (1.181 inch) diameter holes. The diameter of the hole is to be sufficiently large to allow flowable polymer material to flow under pressure.

Preferably the hardenable material starts to set within four hours after injection to become rigid with compressive strength of greater than 1 kg/cm$^2$. This material can be a foamable polymer or multi-component polyurethane expanding to become rigid foam through a polymerisation process after mixing at the injection hole, or premixed foam concrete or premixed fast setting cement slurry.

Uplifting movement can be monitored made using a Benkelman beam or a straight edge or a displacement dial gauge or laser level or an altometer such as ZipLevel™ made by Technidea Inc. The uplifting movement can be monitored with each pass.

Preferably at least one relief hole is drilled, or a number of holes are drilled within a distance of 1 m to 3 m from the injection hole so that non-solid components under the slab such as air, water can escape, allowing grouting material to substantially fully occupy the void(s) underneath.

Optionally a small amount of material is injected at a new location between the injected holes after the slab is raised sufficiently. The amount injected is enough to fill the void(s) that may be left between the lifting injection process, and this injection is stopped when there is any sign of upward movement of the slab. This is to prevent possible tensile cracks due to lack of support or existence of voids below the slab.

The joint ties may be placed across crack lines. The ties are preferably prefabricated metal plate of 4 mm to 8 mm thick inserted into saw cut slots with width of cut slightly larger than the joint tie thickness. The joint ties preferably have 1 mm deep crossed grooves on both ends of the ties to increase surface contact and shear strength of the bonding material. The saw cut slot may also have not-through drilled holes along the slot in a 45 degree angle to vertical direction to increase surface bonding and to also increase shear strength of the joint tie system.

Preferably the joint tie is placed beyond the end of crack line to prevent propagation of the crack when rigid pavement is subject to cyclic loading.

Preferably the bonding material has tensile strength greater than shear strength of the base concrete where the tie is affixed to. This material may be a polymer such as urethane or epoxy.

Preferably small vibration or hammering action is applied to the joint tie so that air bubbles can escape and full surface contact between bonding material, the joint tie and cut slot can be achieved.

The joint ties may be placed across an expansion joint. The middle of the joint tie may have a half circle kink along the width to allow for deformation along longitudinal direction to accommodate for expansion/contraction movement of the slabs. A hole saw cut (e.g. of 40 mm diameter) may be made to accommodate the kink on the joint tie (e.g. where the saw cut slot intersects with the expansion joint).

Preferably the selected hardenable material starts to set within four hours after injection to become rigid with compressive strength of greater than 1 kg/cm$^2$. This material can be a foamable polymer or multi-component polyurethane expanding to become rigid foam through a polymerisation process after mixing at the injection hole, or premixed foam concrete or premixed fast setting cement slurry.

BRIEF DESCRIPTION OF DRAWINGS

The Figures illustrate various examples of the methods and apparatus disclosed herein.

DESCRIPTION OF EMBODIMENTS

Figure 1:
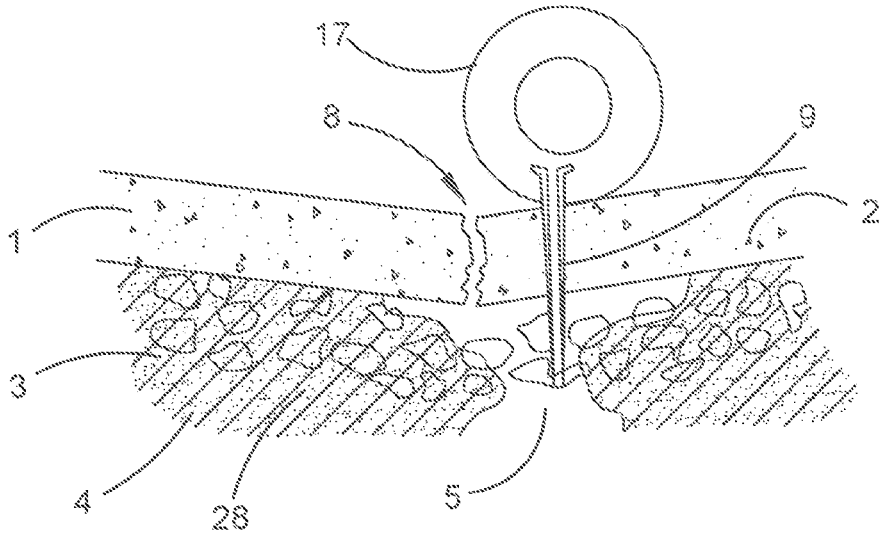
FIG. 1 is a cross-section view of a cracked, particulate supported, slab at an initial stage of treatment.

In one example, a slab 1, 2 which is deformed and sunken is raised by injecting, through a drilled-to-sub-grade hole 9, material 25 such that the injected material will exert about 0.2 MPa (29 psi) to 3 MPa (435 psi) to the surrounding soil. The injected material may be a slurry cement grout or expanding polymer and is shown in the Figures by hatching upwardly inclined to the right.

The higher end of the range is suitable for slabs (or foundation pads) for which higher loads are planned, such as the slabs of an airport runway—a 30 m$^2$ (98 ft$^2$) slab in an airport runway may have to withstand impact loads (due to heavy landings) of about 150 tons (i.e. about 1.5 MN). On the other hand, the lower end of the range is suited to slabs for which lower loads are planned, such as the slabs of a sidewalk. A pressure of about 0.5 MPa (72.5 psi) at nozzle is a recommended minimum for normal rigid pavement such as roadways, taxiways or warehouse floors. By way of example foam/cement mix (light weight concrete) may be pumped in under normal air pressure at 0.5 MPa (72.5 psi) to 0.8 MPa (116 psi), being the pressure available from most normal air pump compressors.

Whilst 5 kg/cm$^2$ (70.9 lbs/in$^2$) is thought to be ample for lifting most slabs, higher pressures are preferred. Preferably polymer equipment supplying about 10 MPa (1450 psi)-20 MPa (2900 psi) at pump pressure which (minus losses) gives 1 MPa (145 psi) to 3 MPa (435 psi) nozzle pressure is used.

Good soil would have shear strength of 0.2 MPa (29 psi) upward, and this injection pressure can improve the soil further.

Material is preferably injected into the soil rather than into the sub-base. If expanding material/grouting material under pressure applies force to the ground/soil 4 with sub-base in between, the stress caused to soil (or the corresponding degree of consolidation/compaction) would be less, therefore it is less effective in terms of trying to put higher stress to soil 4 (hence bring its "past overburden pressure" to a higher level, changing the values of soil's plastic state and elastic state).

Injection below the sub-base (as opposed to injecting into the sub-base) uses more material but leads to a better longer lasting result. The soil is more "consolidated". If injection is made on top of the sub-base, the strength of the sub-base will make lifting easier, but the soil is not improved much, and resettlement may follow.

About 12 to 15 meters (39 ft to 49 ft) is a practical maximum depth of injection using certain existing equipment. 12 m is a readily available tube length, although a few more meters can be achieved by welding another section to it.

To insert the injection tube into the ground, a core shaft (or "spear") with a shoulder at the top end (or "driving end")

and a pointed tip at the other ender is inserted into the tube. The core shaft is for example about 8 mm to 9 mm in diameter to suit a ½" tube with 1 mm wall thickness is used. The core shaft is dimensioned to protrude out of the tube by about 4" to 8".

A hole is drilled through the concrete, sub-base (which may include crushed rock) to get to the native soil. The tube and spear assembly is inserted, and hammered down using any hammering suitable device. An electric hammer such as demolition hammer or rotary drill hammer with hammering only control, between 1000 w to 1500 w in electricity consumption, is found to be an effective device to drive the tube/spear assembly down.

When the tube reaches a desired depth (where there are weak soils to be improved/compacted), the spear is removed slowly to avoid soil/clay being vacuumed back into the tube and blocking material from flowing out. Thus, the depth of injection may be dictated by the actual physical layer(s) of material which are revealed during either soil investigation or Dynamic Cone Penetrometer (DCP) probing. Ideally the tube is then extracted a short distance, e.g. extracted by a couple of inches, to aid the flow of injecting material.

A similar approach to depth selection may be applied to any subsequent injections through the same injection hole. Injected material will run under pressure to the points of lowest resistance, filling the voids and fissures below the sunken slab. Air, water and/or water-and-fines mixture may be present below the slab or sub-grade, hence desirably vent/bleed hole(s) are made in the slab (e.g. at 1 m to 3 m (3.3 ft to 9.8 ft) away from the injection hole) for non-solids to be expelled to enable the filling material to fully occupy any voids.

With continued injection of material, the slab will rise when the expansion force on the slab is infinitesimally higher than the combined weight of the slab and any loads carried thereby. As the slab starts to move upward, a composite system of ground, sub-base, and grouting material will have modulus of elasticity changed to a value that is able to take the slab load above without being further depressed.

The injection can be enhanced by at least partly drying the particulate. Water movement through the soil is very slow. When material is injected without drying, it is resisted by water within the soil which cannot escape fast enough. After the injected material has set, there is a high pressure zone in the subsoil water immediately surrounding the injected material. This subsoil water eventually weeps away and so the soil relaxes and is no longer pressurised as it should be.

For saturated soil, a vacuum tube set at 40 kPa (5.8 psi) to 80 kPa (11.6 psi) is placed within a 2 m radius of the injection point, to assist the flow of water, reducing hydrostatic pressure build up that would negate the effect of grouting pressure.

To prevent post-injection settlement (i.e. further depression of the composite support system) from recurring during service after the repair, weight 17 is added around the local area being lifted to simulate actual in service conditions. The added weight could be a mobile counterweight or rear axle weight of a loaded truck. For a factory floor, the weight should be machinery and goods normally loaded on the floor. For road pavement, the added weight should be around 8 T or more on a rear axle to simulate real life conditions.

During injection, the effects of injection are monitored to provide an indication of progress. This may involving monitoring the resistance to injection (e.g. a ratio of the injection rate to the injection pressure, the changing resistance being an effect of injection) or sub soil pressure (e.g. with transducers spaced from the point of injection) but preferably is monitoring surface deflection. Surface deflections may be gauged with a Benkelman beam, optical auto level, laser level, displacement gauge, straight edge, dial gauge, altometer (such as ZipLevel™ made by Technidea Inc) or Falling Weight Deflectometer (FWD). A vane shear test device may be used to ascertain that the shear strength of soft ground has improved to the desired level after injection. A DCP probe may be used to ascertain that soil resistant to dynamic loading of the DCP has improved to the desired level after the injection.

Since flowable material will flow under pressure to the point of lowest resistance, material may flow away from the injection location, and lifting may occur at some point away from the injection point, and monitoring of upward movement of the slab is desirable at multiple locations to prevent over-lifting. This monitoring can be in the form of string lines, laser device, level meter, displacement gauge or any other apparatus capable of monitoring elevation.

Lifting the slab with a smaller pressurised area below the slab is more desirable because the pressure needs to be higher for a smaller area to generate the required lifting force to raise the slab and the surcharge above it. Because of this, two component self-expanding polymer is preferred over the other materials due to its quick foam formation which prevents material from flowing too far from the injection point.

Preferably the hardenable material sets within an hour after injection to become rigid with compressive strength of greater than 5 $kg/cm^2$. This material can be a foamable polymer or multi-component polyurethane expanding to become rigid foam through a polymerisation process after mixing at the injection hole, or premixed foam concrete or premixed fast setting cement slurry. Expanding polymers (and other expanding materials) increase in volume after injection.

A hydrophobic polymer resin (when mixed with, to react with, a suitable hardener) will form rigid foam in a few seconds. The injection material may have a blowing agent to adjust the expansion rate of foam. To confine the flow of expanding polymer, the foaming time of the polymer after injection should be in the range of 10 seconds to 60 seconds, and this can be further adjusted by variation in temperature of the resin and hardener at mixing. Gel time and cream time are temperature dependent—the higher the temperature the shorter the cream time. The mixing is controlled by proportioner equipment.

During injection, the rate of injection is preferably reduced, and most preferably periodically paused (i.e. reduce to zero), to allow time for the effects of injection to become apparent. The inventors have recognised that various effects of injection (e.g. surface uplift) are not immediately apparent. In the case of expanding injection material, the surface can continue rising after injection has ceased.

The reduction in injection rate of the material is preferably periodic pausing. This could simply be fixed alternate periods of injection and pausing, or the length of the periods may vary in accordance with a schedule and/or in response to monitored effects of injection. By way of example, the periods of injection may be shortened as injection approaches completion. The discontinuous injection may be controlled by automated means or simply by a user.

Injection in short bursts has been found to give better control over the expansion force. The bursts should be long enough to have new mixed material expelling old mixed material out of the injection tube. The pause should be short enough (less than the setting time of the material) so mixed material in the injection remains flowable and can be pushed out by newer mixed material in the next injection cycle. The ideal amount injected each time is between 0.5 L to 2 L (0.13 gal. to 0.53 gal.) to confine the expanding polymer within the 0.4 m-to-1.5 m (1.3 ft to 4.9 ft) effective radius around the injection hole. In case a smaller effective area is required, an even smaller amount should be injected, then pause to wait for the polymerisation process. A smaller effective area when the weighted portion of the slab is lifted means the system modulus of elasticity is higher, reducing the risk of further settlement.

During lifting the elevation is monitored and the amount of lift, as a rule of thumb, should not be higher than 2 mm-3 mm (0.079 inches to 0.118 inches). This is to maintain the strain rate on concrete surface to approximately 1/500 to avoid cracking. For a larger and deeper depressed area to be lifted, the polymer injection should be made in multi passes.

A column of injection material, either fast setting slurry or expanding polymer, can be made to form a pillar from the injecting point to the base of the structure by withdrawing the injection tube while injection material continues to flow.

Figure 7A:
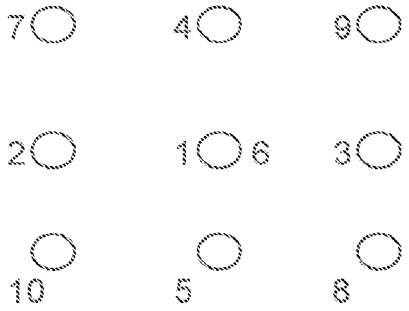
FIGS. 7*a* and 7*b* are plan views of injection patterns.
Figure 7B:
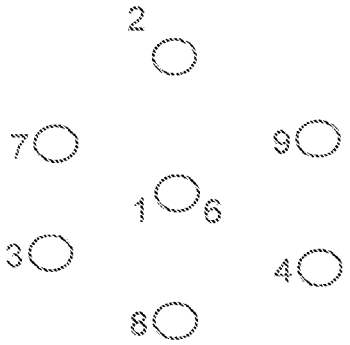
Figure 8:
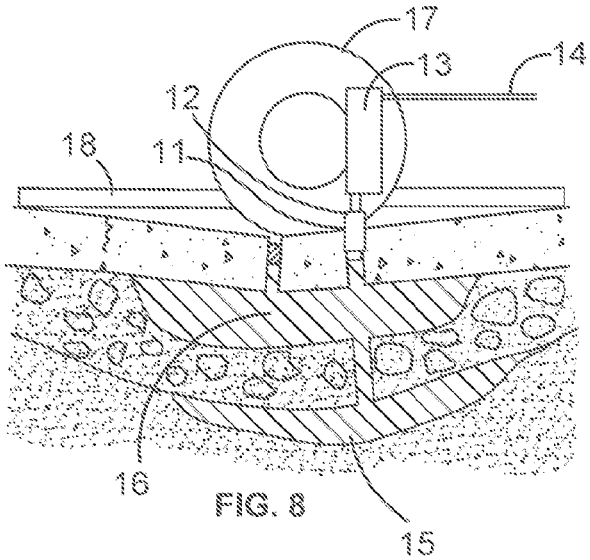
FIG. 8 is a cross-section view of the slabs of FIG. 6 at a subsequent treatment stage.
Figure 9A:
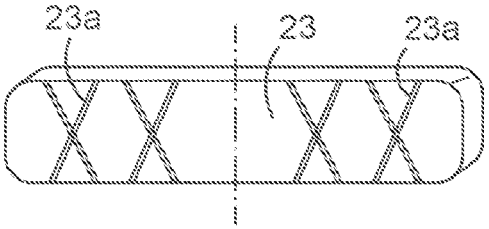
FIG. 9*a* is a perspective view of a joint tie.
Figure 9B:
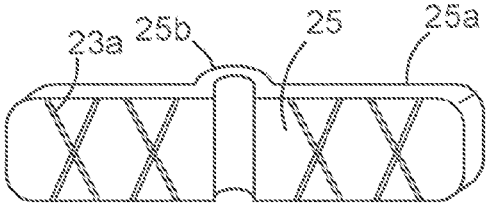
FIG. 9*b* is a perspective view of an alternative joint tie.
Figure 10:
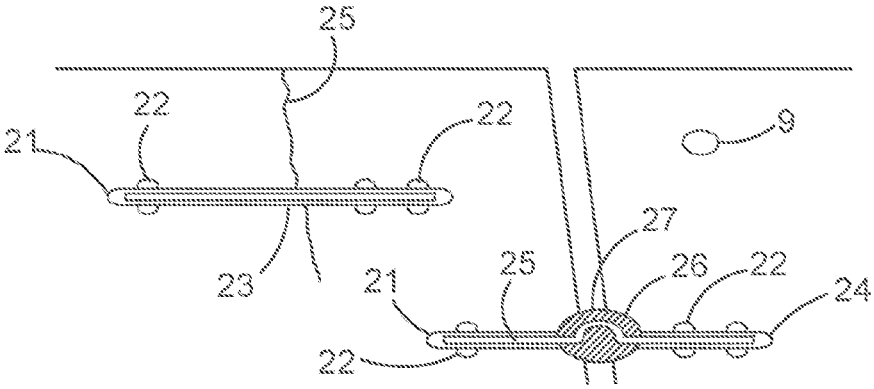
FIG. 10 is a plan view of joint ties connecting slab portions.

With reference to FIGS. 2, 3, 7*a* and 7*b*, the repair starts at the injection hole with lowest elevation, moving radially outward. FIG. 7*a* shows a square array of nine injection holes (i.e. a square pattern). FIG. 7*b* shows a central injection hole concentrically surrounded by a circular array of 6 equispaced injection holes. This pattern is referred to as a triangular pattern.

In FIGS. 7*a* and 7*b* the injection holes are numbered suggesting the injection sequence. The sequence commences with the central hole, followed by some of the outer holes in an order selected to minimise asymmetrical loading, a return pass to the central hole, followed by the final outer holes.

A second (and any subsequent) injection operation though the central hole (or any other hole in need of multiple passes) avoids drilling too many holes on the concrete slab. It is preferred that between injection operations, the injector be removed and the hole re-drilled with a slightly smaller or equal diameter to original injected hole. This is to ensure that same size injector will still fit.

Figure 2:
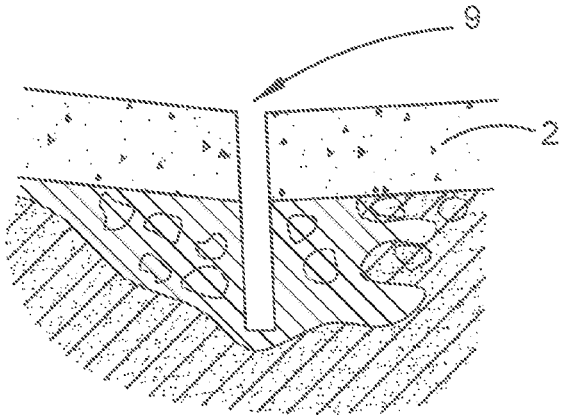
FIGS. 2 and 3 are cross-section views illustrating subsequent treatment steps.
Figure 3:
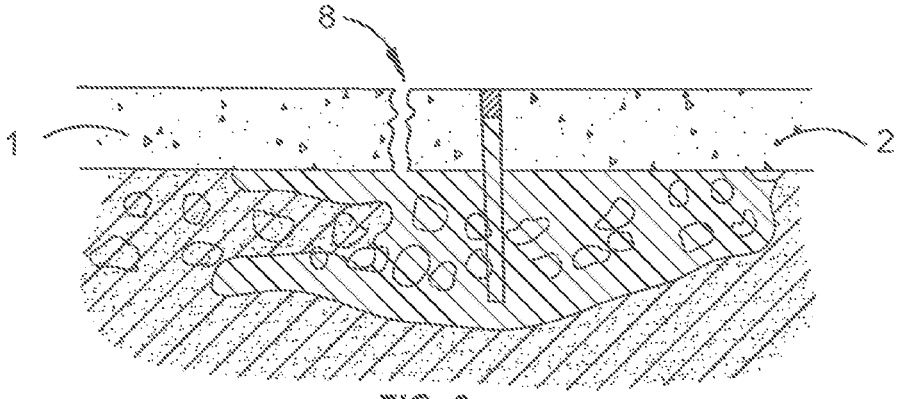
Figure 4A:
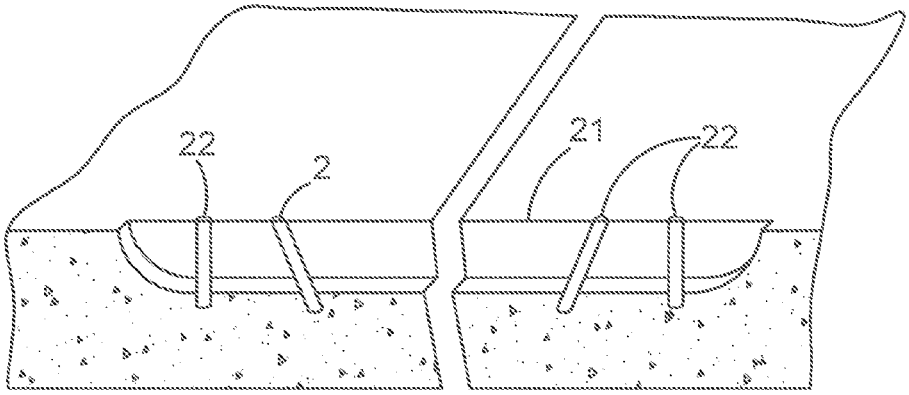
FIG. 4*a* is a cut-away view along a slot for connecting slab portions.
Figure 4B:
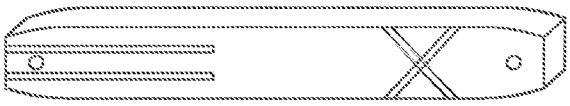
FIG. 4*b* is a perspective view of a joint tie.
Figure 4C:
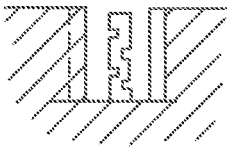
FIG. 4*c* is a transverse cross-section view of the slot carrying the tie.
Figure 5:
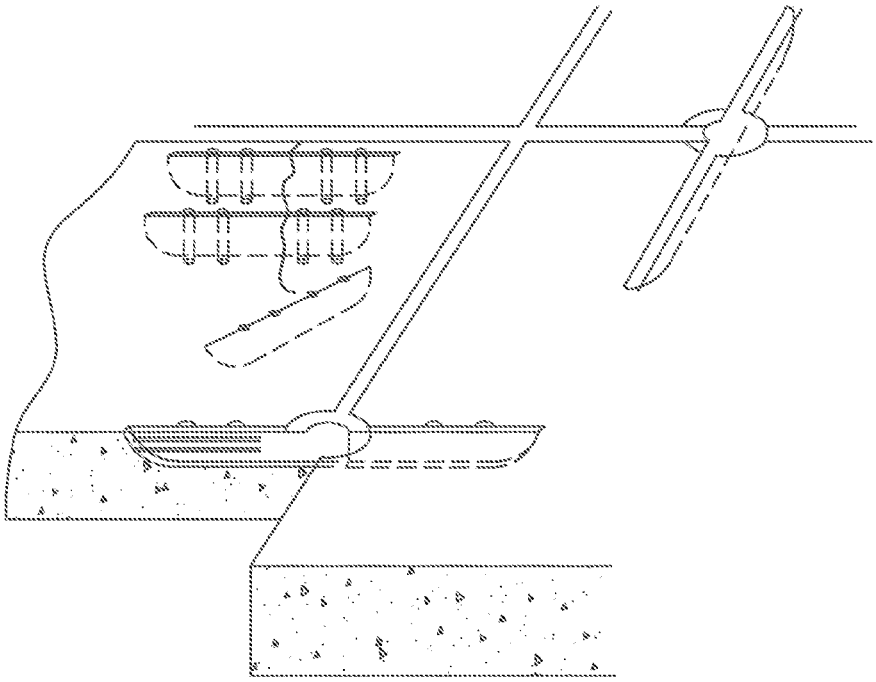
FIG. 5 is a partially cut-away view illustrating an arrangement of slabs and ties transferring load between various slab portions.

The "re-drilled hole" should be slightly deeper than the last hole, so that the drill bit will not just penetrate through the sub-base, but it will also pierce through the polymer foam already formed between the sub-base and the soil. Newly injected polymer under pressure will also flow through this pierced layer to form new foam layer between the soil, sub-base and concrete slab. This force further enhances the combined system rigidity and therefore becomes lifting force. Material injected during the second pass is shown in FIGS. 2 and 3 with hatching downwardly inclined to the right.

Once the rigid pavement is lifted to the desired level, another injection in between the injected points should be made to fill the voids which may still exist. This hole also should be drilled through the sub-base layer. Care should be exercised not to over-inject as the voids, if any, should not be as large. At this stage, injection should be stopped if there is any sign of lifting happening.

Once levelness of the sunken portion is achieved, the holes should be plugged with a suitable plugging material (e.g. a compatible cementitious mix or polymer mix) and it is desirable that any cracks 8 be repaired with crack repair epoxy. Work site preparation is important for the bonding to work properly. In case of severe cracks, the bonding between cracked surfaces may not be enough for load to transfer properly across the broken portions, and the use of joint tie 23 becomes desirable.

In this example, the joint ties 23 are the flat metal plates with thickness slightly smaller than the width of a circular saw cut 21. These plates can optionally be electroplated or otherwise surface treated to prevent rusting, or made of stainless steel.

Preferably the saw has a diamond blade. Wet cuts normally help protect the blade life, prevent dusting, but the cut must be cleaned and dried afterward. Compressed air should be used to clean away the fines in the slot, and also to dry the cut. Not many bonding polymers work well on a wet surface, therefore cleaning and drying the cut slot is highly desirable.

The joint ties 23 should be made approximately perpendicular to the crack line, spacing generally between 1 to 2 times slab thickness, and this spacing may be varied to be tighter if the joint ties are made with width slightly smaller than half of slab thickness. This is to ensure that load transfer devices can adequately take the full load. To prevent propagation of the crack when the repaired slab is put in service, a joint tie should be placed past the end of the visible crack line, preferably away from the end at a distance between 1 to 2 times the slab thickness.

Structural reinforcement bars are normally placed at or near the bottom of the slab, therefore the saw cut should only be made to about ½ of slab thickness and should not extend beyond ⅔ of the slab thickness. The metal joint ties 23 should be made with thickness such that each of the metal plate fits loosely in the cut slot 21, leaving enough gaps that bonding material can run in under gravity. The width of the metal plate should be (i) less than depth of cut by about 5 mm, (ii) at least half of the slab thickness.

The inventors have recognised that the weakest point in various existing jointing systems is the bonding and that increased surface contact is desirable to improve the bonding. This is achieved by drilling a series of not-through holes typically of 16 mm diameter, although smaller or larger diameter holes also work, along the saw cut. 8 mm diameter is considered a practical minimum. Two to three holes on each side would be sufficient. The drilled holes provide more surface contact to aid bonding. The holes can be in vertical direction or at an angle to the vertical direction, although an angle of 45 degrees to vertical axis is preferable.

The slot 21 and holes 22 are together an elongate formation. Cutting and drilling are material removal operations. The holes 22 constitute side formations deviating from the width of the cut. During installation the received adhesive fills and conforms to the holes 22. When set, the so conforming portions of adhesive constitute keys, the holes 22 constitute keyways and there is positive engagement to resistant lengthwise shearing (i.e. shear in a direction parallel to the length of cut 21).

Whilst the use of joint tie 23, 25 is much preferred, the formation 21, 22 could simply be filled with settable material.

On the metal joint tie plate, a series of side formation 23*a*, 25*a* are provided to improve the engaging of the plate 21 with the adhesive. The side formations are preferably female as in horizontal, angled, holed or crossed configuration cut lines, most preferably 1 mm (0.039 inch) deep grooves. The side formations may be on both sides of the metal plate. The middle part of the metal joint tie carries greatest bending moment when the load transfer is active, therefore no drilled holes, no milling, no recesses should be made on this portion to preserve the strength of the tie.

Straight joint ties can be made for jointing cracks or broken pieces within a concrete slab. When the joint tie is made across different slabs (e.g. to replace or augment damaged load transferring dowel bars), horizontal movements should be allowed for to account for expansion or contraction. A relatively flexible portion 25*b* (e.g. kink) at the middle of the tie allows for relative displacement of the slabs in both transverse and longitudinal directions. This is a half circular kink or U shape that is preferably preformed in the metal joint tie. After installation, this kink area placed at the expansion joint is filled with flexible joint sealer, preferably with a typical Shore A hardness of 15 to 40.

Bonding material can be placed in the slot prior to or after placement of the joint tie. If fine aggregates such as clean dry sands are mixed with bonding material, they should be added after the joint tie is in place. Vibration or hammering about the tie encourages air bubbles escapes to improve the surface contact with bonding material on both slab wall and the joint tie. It is highly desirable that both cut slot and the joint ties are clean and dried, free of dust, oil or moisture.

By way of example, the bonding material can either be epoxy, urethane or polyurea-based polymer that would have bonding strengths greater than shearing strength of concrete.

Joint ties 23, 25 are formed from rectangular plate. This is a convenient shape which sits neatly in an elongate slot 21 of constant depth. Other shapes are possible. Other variants of the plate may have a curved based. E.g. Three separate ties could be formed by cutting a 14" disk along a triangular pattern of chord lines. Joint ties so formed would neatly conform to a slot made by a single vertical movement of a (rotating) 14" saw blade.

Figure 6:
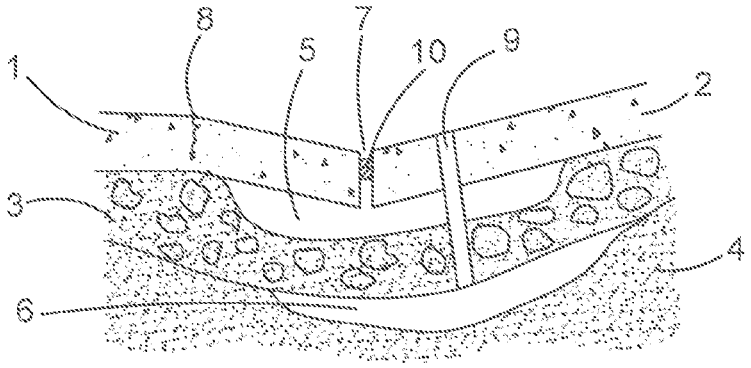
FIG. 6 is a cross-section view of the juncture of a pair of adjacent, particulate supported, slabs at an initial stage of treatment.

FIG. 6 illustrates two slabs 1 and 2 connected by an expansion joint 7 filled with joint sealer 10. Slab 1 has crack 8 which may extend fully through the depth of the slab. Pumping may occur and void 5 could present below the slabs, containing air or water or water-mixed-with-fines-soil. Below the slab there could exist a course of sub-base 3 which may be damaged around the depressed area of the slab above. Soil 4 below the sub-base may have further voids or interconnected voids 6.

To treat the particulate 3, 4 to re-level and reinforce slabs 1, 2, a hole 9 is drilled. The hole 9 passes through the sub-base 3 to soil layer 4.

The hole is preferably about 16 mm (0.63 inches) for the injection of multi-component expanding polymer. For cement grouting, this hole should be between 24 mm to 32 mm (0.944 inches to 1.26 inches), depending on the slurry and injection equipment. Diameters in the range of about 6 mm to 40 mm (0.236 inches to 1.575 inches) are considered practical. The holes 9 should be between 0.5 m to 2 m (1.64 ft to 6.56 ft) apart. For expanding polymer injection, the distance should be about 1 m to 1.5 m (3.28 ft to 4.92 ft).

On top of the slabs 1, 2 as close as possible to the injection hole 9, weight 17 is added to simulate real loading condition. For road and taxiway pavements, the weight should be a vehicular axle or equivalent carrying 8T.

An injector 11 is hammered into the drilled hole such that its friction is strong enough to resist a pullout force of approximately 300 kg (661 lbs) or greater for injection hole of 16 mm (0.63 inch) diameter. This pullout force is proportional to the hole's diameter. If the slab 1 is topped with layer(s) above it, the injector should be placed to the bottom layer and above the sub-base. This is to prevent delaminating of the topping layers. A typical example of this is semi-rigid asphalt coating over Portland cement concrete in road pavement, which exists in many highways or runways.

On top of the injector 11, a coupler or valve 12 is affixed to enable attachment of injection gun 13 which provides total control of the flow of resins which are fed through a set of hoses 14 from the material pump.

Injection of resin should be made in intervals, with each injection cycle providing between 0.5 L to 2 L, pausing not longer than gel time of mixed resin material.

For raising a sunken slab, a stringline or Benkelman beam 18 is to be used to monitor the uplift of the slab during injection. The uplift movement should not exceed 3 mm to avoid tension cracks due to lifting. For simple void filling, a laser level or infrared device can be used to detect upward movement.

Injection must be made in order, firstly from the lowest point (point 1) and moving outward (points 2, 3 and 3, 4), with reinjection at the most sunken point at each cycle (point 6), until all are raised sufficiently. During the injection, the surcharge weight should be placed as close to the injection point as practicable.

Each reinjection, the hole must be redrilled past the layer of injected material 15 so newly injected polymer can again apply expanding pressure between soil and the layer of sub-base or concrete slab above the soil to raise the slab and weight above. Once injected material is set, the injection apparatus can be removed for using on the next hole. A valve 12 may be used to allow the removal of the injection gun before material is set.

Once the broken piece is raised to the desired level, load transfer ties 23 can be installed across cracks that fail to transfer load (typically cracks which are larger than 1 mm in width). These load transfer ties are zinc plated preformed steel plate of 4 mm thickness, with cut lines 23*a* preferably in diamond or X pattern. These cut lines will increase bonding strength, avoiding shearing failure of bonding material along the tie's surface when the load transfer is active. The ties will have vertical width (W) of ½ to ⅔ of slab thickness, and length (L) of greater than three times the vertical width (typically $3W<L<6W$).

To insert the tie, saw cut 21 is made with a diamond cutting blade of depth to be 5 mm to 8 mm (0.197 inches to 0.314 inches) deeper than the width (W) of the tie. Bonding assist holes 22 must be drilled on the concrete to just beyond the depth of the saw cut. These drilled holes will provide extra surface contact for better bonding to concrete surface. At least one hole is to be made on each side of the crack.

After cleaning out cut slot 21 and drilled holes 22 with dry air (safety precaution should be observed to protect eyes and ears), epoxy or urethane adhesive 24 can partially be poured or pumped into the slot, then the joint tie 23 placed in position. The joint tie 23 should be at least 3 mm (0.118 inches) lower than slab surface 1 and bonding epoxy 24 can be poured in until the material totally fills the cut slot 21. Light tapping or vibration must be applied to joint tie 23 so that any air bubbles trapped inside the bonding epoxy 24 can escape to ensure that cut grooves 23*a* and drilled holes 22 are totally filled.

Crack 25 should also be filled with crack repair epoxy using low pressure pump or syringes as per manufacturer recommendation.

When a joint tie is made across the expansion joint to restore damaged dowel bars, the ties 25 will have half circle kink 25*b* of 20 mm (0.787 inches) wide in the middle. Grooves 25*a* retain the same details as those 23*a* used on flat joint ties 23 for strengthening cracks.

The kink 25*b* will be placed at the expansion joint where a hole saw 26 of 40 mm (1.57 inches), although a larger hole or slightly smaller hole is also acceptable, is made to accommodate the kink with adequate clearance to allow for horizontal movement. This hole 26 will be filled with flexible sealer such as silicone or bituminous sealer 27. Once the bonding material 24 has adequately set and gained strength (preferably at least higher than concrete), the slab can be put back in service (e.g. the roadway can be opened to traffic).

Pumping (and/or other factors) can lead to an entire structure sinking. The inventors have discovered that by sequentially injecting material at injection points about the structure (rather than simultaneous injection at multiple points or a single larger injection) leads to soil about each injection point being stressed beyond the necessary average, leading to improved soil compaction.

As noted, in extreme cases voids may form between, and separate, particulate and overlying structure. For the avoidance of doubt, material injected into such voids will act on the underlying particulate. Accordingly, so injecting fits the description of treating the particulate as these words are used herein.

The invention claimed is:

1. A method of treating particulate, the method comprising:

selecting a load based on a planned in use loading of the particulate;

applying the load to the particulate;

injecting material below the load;

allowing the injected material to set;

creating a hole in the set material;

injecting through the hole further material below the set material; and removing the load.

2. The method of claim 1 wherein the injected material is an expanding material.

3. The method of claim 1 wherein the load is further particulate.

4. The method of claim 1 wherein the load is selected to exert a pressure of at least 1,000 kg/m$^2$ (1.4 psi) averaged over an area of the particulate in need of treatment.

5. The method of claim 1 including sequentially so injecting at a plurality of locations.

6. The method of claim 5 wherein a first of the sequential injections is in substance at a centre of an area of the particulate in need of treatment.

7. The method of claim 1 including reducing a rate at which the material is injected to allow time for at least one effect of injection to become apparent.

8. The method of claim 7 wherein the reducing is or includes periodically pausing the injection.

9. The method of claim 1 including, prior to the injecting, at least partly drying the particulate to reduce resistance to injection.

10. The method of claim 9 wherein the at least partly drying is to reduce ground water pressure by about 40 kPa (5.8 psi) to about 80 kPa (11.6 psi).

11. The method of claim 9 wherein the at least partly drying is or includes vacuuming.

12. The method of claim 1 including monitoring at least one effect of injection and discontinuing injection in response to the monitoring.

13. The method of claim 12 wherein the monitoring includes monitoring at two or more spaced locations.

14. The method of claim 12 wherein the monitoring is or includes monitoring surface displacement.

15. The method of claim 1 wherein the particulate is supporting a structure.

16. The method of claim 15 wherein the structure is a slab or slab portion.

17. The method of claim 15 including sequentially injecting material below the structure to a plurality of injection points spaced about and in proximity to a periphery of the structure's footprint on the particulate.

18. The method of claim 15 wherein the injecting is injecting through at least one hole in the structure.

19. The method of claim 18 including creating the at least one hole in the structure.

* * * * *